United States Patent [19]

Barrett

[11] Patent Number: 4,867,040

[45] Date of Patent: Sep. 19, 1989

[54] SELF-UNLOCKING DEVICE FOR RECOILING BOLT CARRIER AND BARREL IN A SEMI-AUTOMATIC RIFLE

[76] Inventor: Ronnie G. Barrett, P.O. Box 1077, Murfreesboro, Tenn. 37130

[21] Appl. No.: 115,821

[22] Filed: Nov. 2, 1987

[51] Int. Cl.[4] ..... F41D 5/02

[52] U.S. Cl. ..... 89/172; 89/174; 89/185; 89/169

[58] Field of Search ..... 89/172, 174, 185, 164, 89/188, 169

[56] References Cited

U.S. PATENT DOCUMENTS

| | | |
|---|---|---|
| 749,341 | 1/1904 | Tobisch . |
| 2,328,108 | 8/1943 | Swebilius . |
| 3,757,636 | 9/1973 | Chiabrandy . |

FOREIGN PATENT DOCUMENTS

| | | | |
|---|---|---|---|
| 411164 | 6/1910 | France | 89/169 |
| 531031 | 7/1955 | Italy | 89/169 |

*Primary Examiner*—Deborah L. Kyle
*Assistant Examiner*—Stephen Johnson
*Attorney, Agent, or Firm*—Harrington A. Lackey

[57] ABSTRACT

A semi-automatic rifle including a recoiling barrel adapted to carry rearward the elongated bolt carrier containing the bolt for compressing the recoil spring, and a self-unlocking device including a self-unlocking rod longitudinally slidably mounted on the bolt carrier normally engaging the rear face of the barrel in a battery position and a trigger actuating device for thrusting the self-unlocking rod forward during the early stage of recoil for separation of the bolt carrier from the barrel before the barrel reaches the end of its recoil movement.

7 Claims, 4 Drawing Sheets

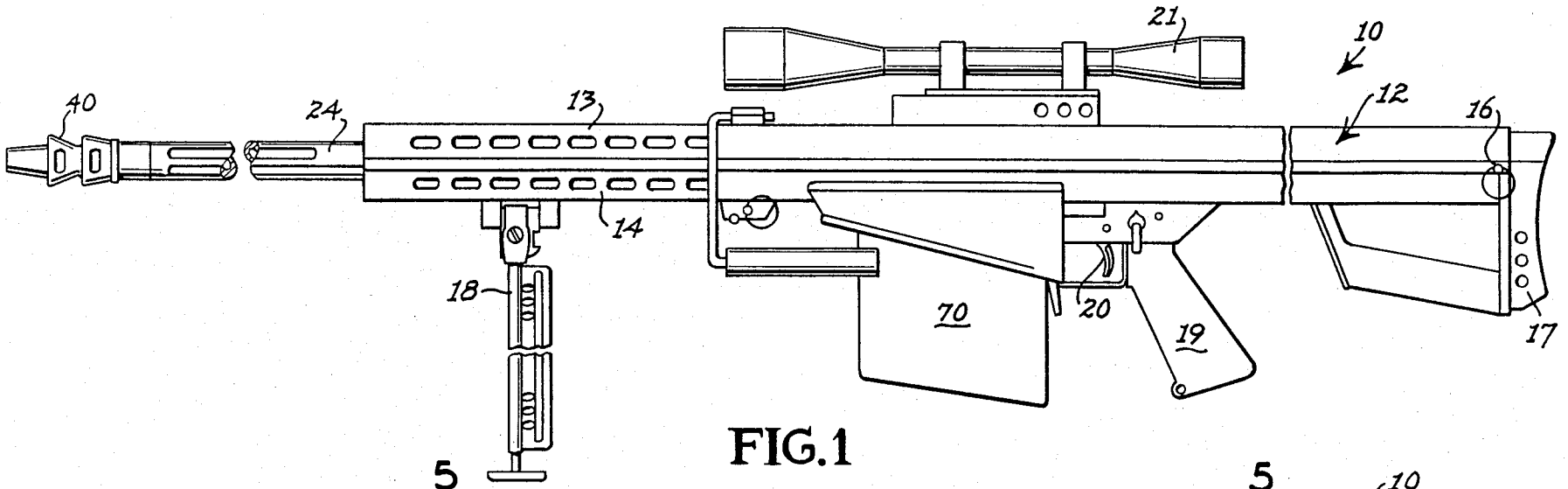
FIG. 1
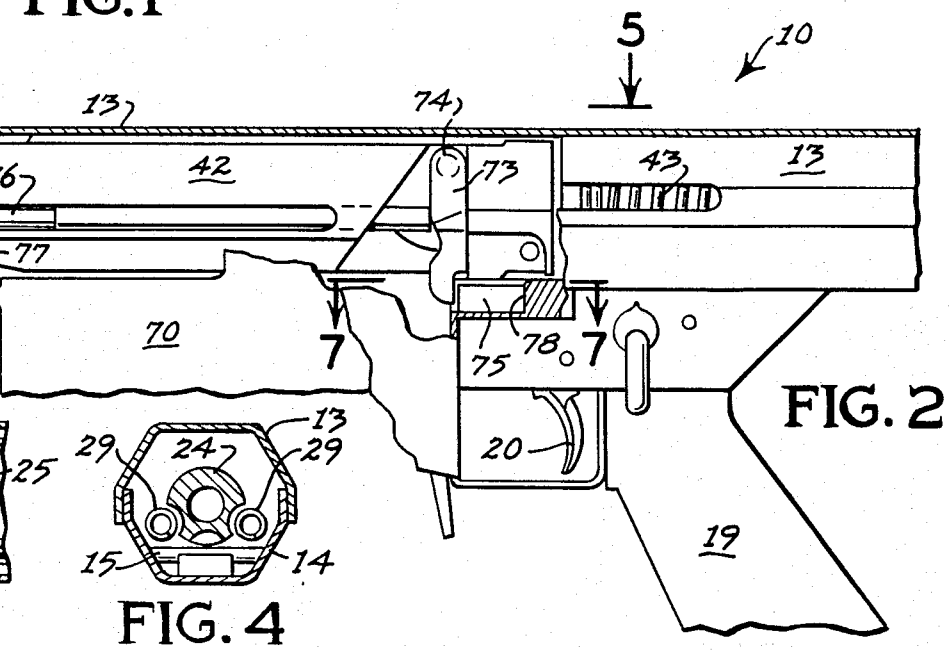
FIG. 2
FIG. 4
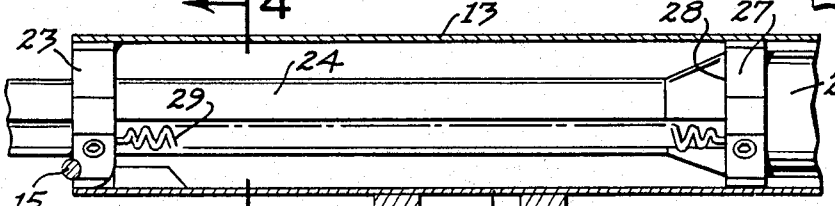
FIG. 3

SELF-UNLOCKING DEVICE FOR RECOILING BOLT CARRIER AND BARREL IN A SEMI-AUTOMATIC RIFLE

BACKGROUND OF THE INVENTION

This invention relates to semi-automatic rifles, and more particularly to a self-unlocking device for separation of the bolt carrier from the barrel in a semi-automatic rifle during recoil.

In the "Anti-Armor Gun" disclosed in my prior U.S. Pat. No. 4,677,897, issued July 7, 1987, a recoiling barrel is provided for carrying rearward the bolt carrier and the bolt, while still locked to the barrel, in order to absorb the energy of recoil after the gun is fired. The front of the bolt is provided with radially projecting bolt lugs which are adapted to engage the locking lugs in the rear end of the barrel in order to lock the bolt within the barrel in battery and firing positions. The barrel is also provided with an abutment member which engages a barrel travel stop fixed within the housing to stop the rearward movement of the barrel. When the barrel stops, the bolt carrier and bolt continue their rearward travel simultaneously rotating the bolt to unlock the bolt lugs from the barrel to completely separate the bolt carrier from the barrel. The barrel springs then return the barrel to its original forward position.

In the gun disclosed in U.S. Pat. No 4,677,897, the rearward movement of the recoiling barrel is always stopped abruptly, placing substantial stress upon the interlocking lugs of the bolt and the barrel. Moreover, the sudden impact and stopping of the recoiling barrel is transmitted in the form of a "kick" to the shoulder of the operator of the weapon.

Furthermore, the extractor mechanism is subjected to a substantial degree of shock and fatigue upon the abrupt stopping of the barrel and the sudden commencement of the extraction of the cartridge.

SUMMARY OF THE INVENTION

It is therefore an object of this invention to provide in a semi-automatic rifle of the above-described type, a self-unlocking device which will commence separation of the bolt carrier from the barrel during the recoil of the barrel before the barrel is abruptly stopped.

The utilization of a self-unlocking device in accordance with this invention provides an advance separation of the bolt carrier from the barrel during recoil and will accelerate the bolt carrier and decelerate the barrel prior to a termination of the recoil movement of both elements. The deceleration of the barrel will permit the barrel to impact the barrel travel stop member with lesser force than normal which will provide less wear and fatigue of the various parts of the rifle, and will produce less felt recoil in the shoulder of the operator.

The additional acceleration of the bolt carrier provided by the self-unlocking device made in accordance with this invention provides extra speed and momentum for the bolt carrier so that a smaller and lighter bolt carrier may be utilized within the rifle.

An early separation of the bolt carrier and the barrel during recoil also creates less shock upon the extractor mechanism.

Furthermore, the extraction of the spent cartridge will occur during the rearward movement of the barrel while the bolt carrier and bolt are separating from the barrel to render the extraction function less abrupt. The speed of the extraction of the spent cartridge is equal to the difference between the speed of the decelerated barrel and the speed of the accelerated bolt carrier.

The utilization of the self-unlocking device made in accordance with this invention permits a smoother firing cycle for the semi-automatic rifle having a recoiling barrel.

BRIEF DESCRIPTION OF THE DRAWINGS

FIG. 1 is a side elevational view of a semi-automatic rifle made in accordance with this invention, with portions broken away;

FIG. 2 is an enlarged fragmentary side elevation of the rifle disclosed in FIG. 1, with portions broken away, and illustrating the elements in battery position;

FIG. 3 is a fragmentary side elevational view of the front end portion of the housing, which is an overlapping continuation of FIG. 2;

FIG. 4 is a section taken along the line 4—4 of FIG. 3;

DESCRIPTION OF THE PREFERRED EMBODIMENT

Figure 14:
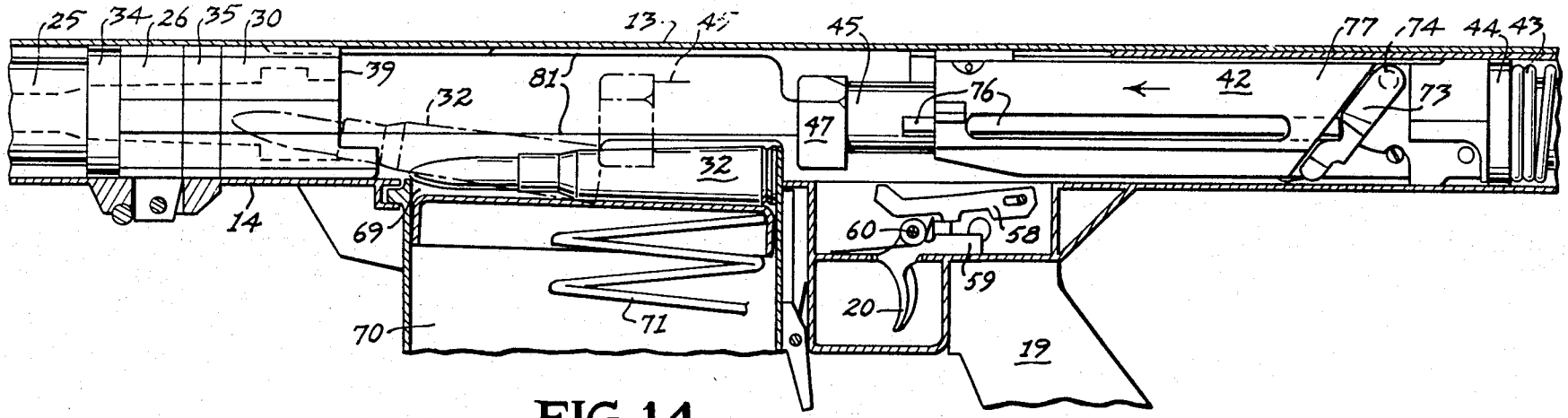
FIG. 14 is an enlarged fragmentary side elevational section of the rifle in which the bolt is moving forward to pick up and chamber a cartridge, and the barrel is in its forward position.

Referring now to the drawings in more detail, FIG. 1 discloses a semi-automatic rifle 10 made in accordance with this invention, including a housing 12 having an upper receiver 13 and a lower receiver 14. The receivers 13 and 14, preferably separable, may be detachably joined about their front ends about the hinge bar 15 (FIG. 3), and secured at their rear ends by the locking pin 16, (FIG. 1). When the receivers 13 and 14 are secured together they form the housing 12 preferably having a polygonal cross-section, and preferably the hexagonal cross-section disclosed in the drawings.

The lower receiver 14 is provided with a rear stock member 17, a front bipod 18, an intermediate depending hand grip 19 and trigger 20. The upper receiver 13 may be provided with a sight, such as the telescopic sight 21 (FIG. 1).

Fixed within the front end of the lower receiver 14 is a front bushing 23 (FIG. 3) for slidably receiving the elongated barrel 24 for longitudinal, reciprocable movement. The enlarged cylindrical rear end portion of the barrel 25 (FIG. 12) is slidably received within a rear bushing or annular stop member 26. An annular key or abutment member 27 is detachably received within a corresponding arcuate slot 28 formed circumferentially in the surface of barrel 24, preferably between the rear end of the reduced portion of the barrel 24 and the integral front end portion of the enlarged barrel portion 25.

Connected between the front bushing 23 and the abutment member 27 are a pair of elongated, coiled barrel springs 29. The barrel springs 29 are pre-tensioned to bias the abutment member 27, and therefore the barrel 24, forward to its forward battery position disclosed in FIGS. 2 and 3.

When the barrel 24 is recoiling rearward, the barrel springs 29 are extended, but the rearward movement of the barrel 24 is limited by the engagement of the abutment member 27 against the stop member 26.

Formed as an integral extension of the enlarged rear barrel portion 25 is an enlarged, hexagonal barrel extension 30 having a front abutment face 33. The barrel extension 30 contains a barrel chamber 31 for receiving a cartridge 32.

As disclosed in the drawings, front and rear annular abutment or buffer rings 34 and 35 are located adjacent opposite ends of the stop member 26, and are made of relatively hard, but resilient material such as hard rubber, to absorb the shock of the impact of the abutment member 27 when the barrel is in recoil and the front face 33 of the barrel collar 30 when the barrel is moving toward its battery position.

The barrel extension 30 includes a locking chamber 36 between the rear face 37 of the barrel portion 25 and a plurality of circumferentially spaced barrel locking lugs 38. The barrel extension 30 includes an exposed rear face or surface 39.

The front end of the barrel 24 is provided with a muzzle brake 40 (FIG. 1).

The polygonal, and specifically the hexagonal, cross-sectional exterior surfaces of the barrel extension 30 and the abutment member 27 are equal, but of slightly lesser dimension than the hexagonal cross-section of the upper receiver 13, so that the barrel 24 travels longitudinally straight within the housing 12 and without rotation.

Also received within the housing 12 behind the barrel extension 30 is an elongated bolt carrier 42 having an upper surface of semi-hexagonal cross-section for complementary slidable movement within the corresponding inner surface of the upper receiver 13. The bolt carrier 42 is received within the housing 12 between the barrel 24 and the rear main or recoil spring 43. The front end of the coiled recoil spring is preferably provided with a buffer pad or member 44 for engaging the rear end of the bolt carrier 42.

A bolt 45, having a cylindrical bolt body 46 terminating in a front bolt head 47 including the circumferentially spaced bolt lugs 48, is slidably received within the front cavity 49 of the bolt carrier 42 for relative longitudinal and rotatable movement. Three bolt lugs 48 are shown.

Figure 10:
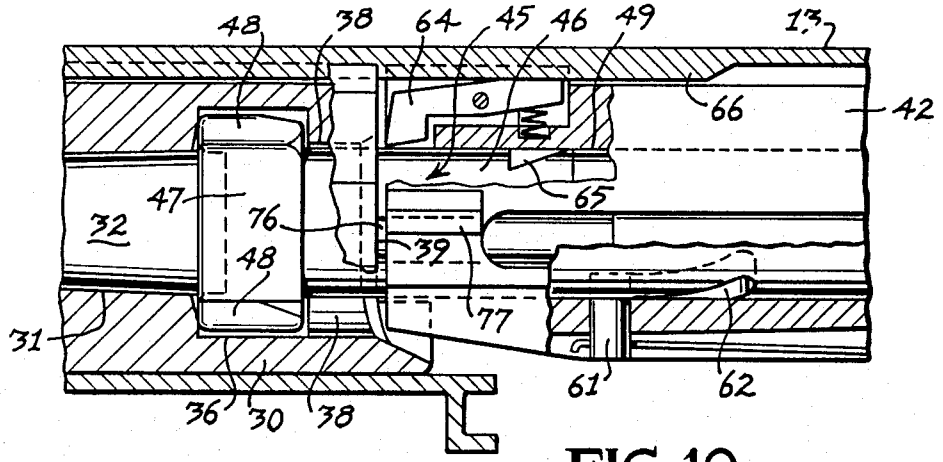
FIG. 10 is a fragmentary section taken along the line 10—10 of FIG. 9, with portions broken away.

As viewed in FIG. 10, the longitudinal dimension of the locking chamber 36 is just large enough to accommodate reception of the bolt head 47, whereby the bolt locking lugs 48 may rotate between engagement and disengagement with the corresponding barrel locking lugs 38, in a well known manner.

The rear end of the bolt cavity 49 defines a rear seat 50 for engagement by the rear end of the bolt 45 in order to limit the rearward travel of the bolt 45 within the bolt carrier 42. A bolt spring 51 is contained within a smaller cavity to the rear of the bolt cavity 49 for urging the bolt 45 forward relative to the bolt carrier 42.

Coaxially and slidably received within the bolt carrier 42 and the bolt 45 is an elongated firing pin 52.

The rear end of the firing pin 52 is provided with a vertical slot 53 for receiving the upper end portion of the cocking lever 54. The rear end of the firing pin 52 terminates in an upturned hook 55 for engagement with the corresponding sear hook 56 of the vertically movable sear 57. The sear 57 is adapted to be moved upward by a transfer bar 58 when pivoted upward by the trigger lever 59 rotating upward on the trigger pivot pin 60 when the trigger 20 is pulled.

Projecting radially inward from the wall of the bolt carrier 42 into the bolt cavity 49 is a cam pin 61 received within an elongated helical slot 62 formed in the wall of the bolt body 46. The cam slot 62 extends helically through an arc of approximately 37 deg. about the circumference of the bolt body 46, so that when the bolt 45 is retracted within the bolt cavity 49, the bolt lugs 48 on the bolt head 47 are rotated through an arc of approximately 37 deg. Since the barrel locking lugs 38 are also three in number and circumferentially spaced 120 deg. apart, a rotation of the bolt head 47 through 60 deg. will permit the corresponding bolt lugs 48 to disengage the barrel locking lugs 38 so that the bolt head 47 is free to move longitudinally into and out of the locking chamber 36 of the barrel collar 30.

In order to retain the bolt 45 in its protracted or forwardly extending position relative to the bolt carrier 42, a 7 pivotal latch 64 is mounted on the body of the bolt carrier adjacent its front end and normally biased into a latch recess 65 in the bolt body 46. An elongated latch actuator rib 66 is fixed on the interior surface of the top wall of the upper receiver 13, so that as the bolt head 47 approaches the locking chamber 36, the rib 66 engages the latch lever to cause it to disengage the latch recess in the bolt body and permit the bolt 45 to rotate within its bolt cavity 49, in a conventional manner.

Figure 6:
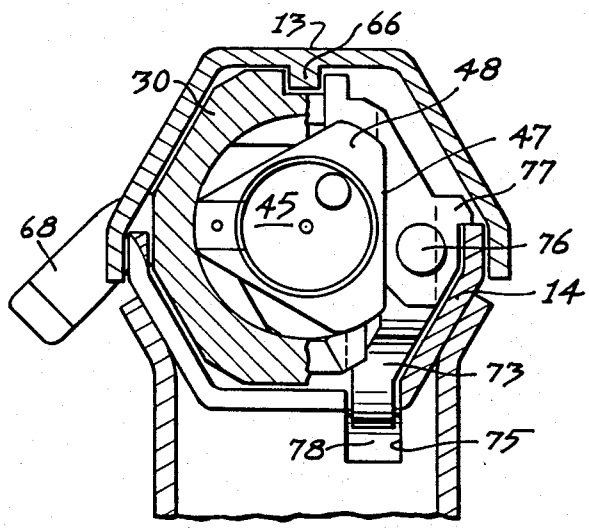
FIG. 6 is an enlarged fragmentary section taken along the line 6—6 of FIG. 5.
Figure 5:
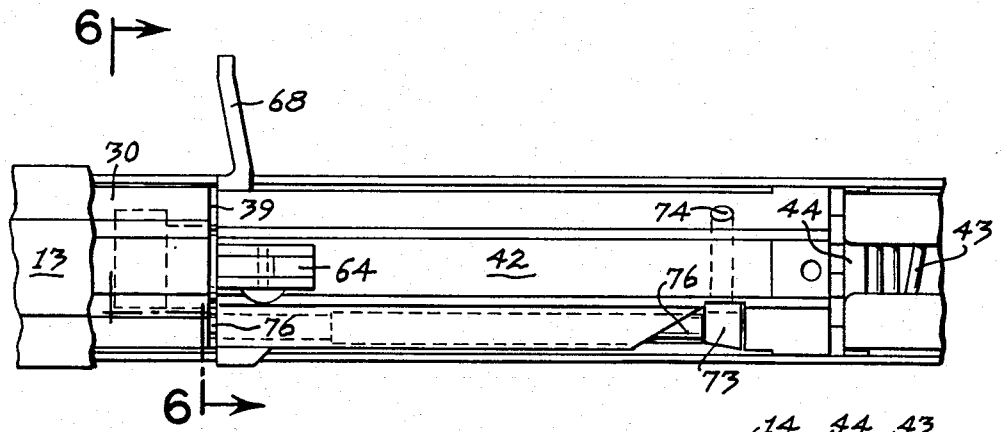
FIG. 5 is a fragmentary top plan view taken along the line 5—5 of FIG. 2, with portions broken away.

In order to manually move the bolt carrier 42 within the housing 12, a transverse bolt handle 68 is provided, as illustrated in FIGS. 5 and 6.

In a conventional manner, an opening 69 is provided in the bottom of the lower receiver 14 for receiving a magazine including a plurality of loaded cartridges which are urged upward into the housing 12 between the rear bushing 26 and the recoil spring 43. Thus, as illustrated in FIG. 14, when the bolt carrier 42 is fully retracted, and then released, the bolt 45 picks up the top cartridge 32 from the magazine 70 and carries the cartridge forward into battery position within the barrel chamber 31.

Figure 7:
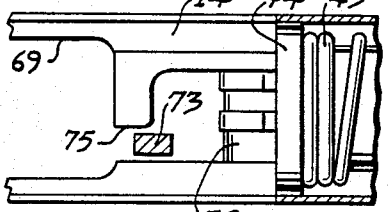
FIG. 7 is an enlarged fragmentary section taken along the line 7—7 of FIG. 2.
Figure 12:
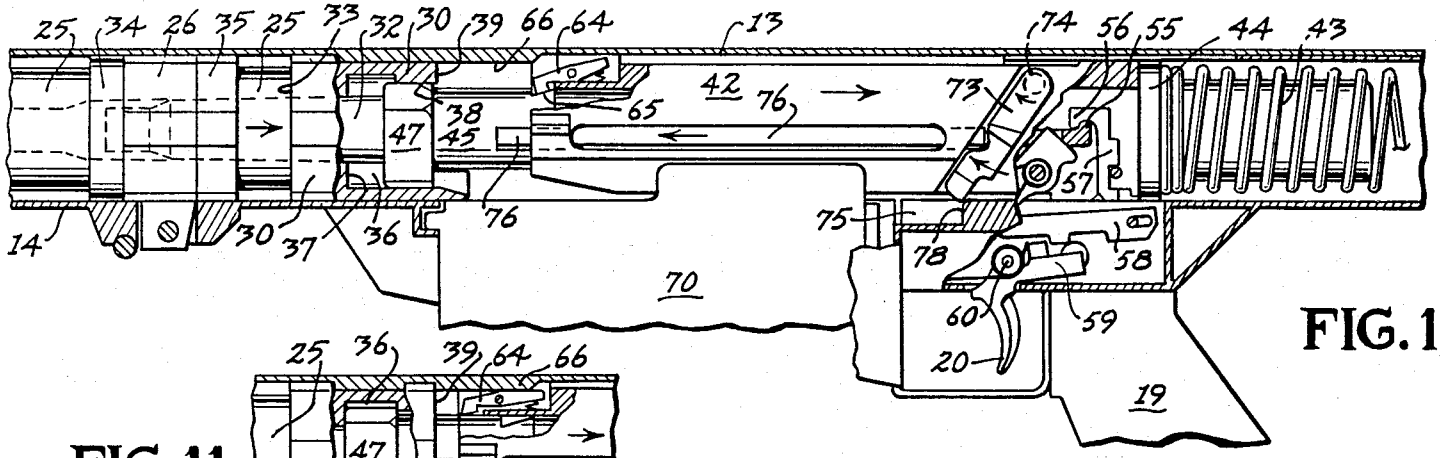
FIG. 12 is a fragmentary sectional elevation similar to FIG. 8, with portions broken away; and illustrating the bolt separating from the barrel, while both are recoiling rearward.

The self-unlocking device made in accordance with this invention includes a self-unlocking lever 73 which has its upper end pivotally connected to the body of the bolt carrier 42 by a pivot pin 74 (FIGS. 2, 12 and 14). The self-unlocking lever 73 is illustrated in the drawings as being pivotally connected to the left side of the bolt carrier 42 when the operator is looking forward toward the muzzle of the barrel. When the self-unlocking lever 73 is in its inoperative, substantially upright, position, as illustrated in FIG. 2, the lever 73 is long enough to depend below the bolt carrier 42 and into a slotted opening 75, which is continuous with and extends rearwardly of the magazine opening 69, as best illustrated in FIGS. 2 and 7.

Adapted to be operated by the self-unlocking lever 73 is in elongated self-unlocking rod 76 adapted to freely reciprocate longitudinally within an elongated guide bearing 77 integrally mounted on the side of the bolt carrier 42.

At the rear end of the lever slot 75 and in the rearward path of the self-unlocking lever 73 is an abutment or shoulder 78 adapted to engage the rear surface of the lower and portion of the self-unlocking lever 73 when the bolt carrier 42 is traveling rearward, as illustrated in FIG. 12. As the bolt carrier 42 travels rearward, and when the lever 73 engages the shoulder 78, the self-unlocking lever 73 is pivoted forward about its pivot pin 74, and while engaging the rear end of the self-unlocking rod 76, projects the rod 76 forward from the front end of the bolt carrier 42, as illustrated in FIG. 12. The self-unlocking rod 76 is long enough so that its front end, when projected forward from the front end of the bolt carrier 42 by the forwardly pivoting self-unlocking lever 73, causes the front end of the rod 76 to engage and bear against the rear face 39 of the barrel extension 30, causing the bolt carrier 42 to move rearwardly and away from the barrel extension 30 and the barrel 24.

Figure 9:
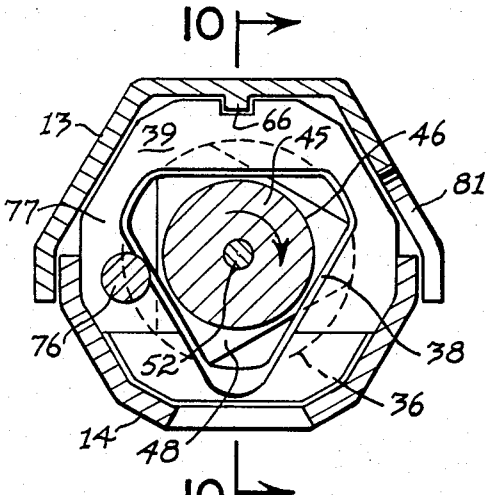
FIG. 9 is an enlarged section taken along the line 9—9 of FIG. 8.

In the normal operation of the rifle 10 made in accordance with this invention, the barrel 24 is normally biased to its forward position by the barrel springs 29, while the bolt carrier 42 is also normally biased to its forward battery position with the bolt head 47 received within the locking chamber 36 of the barrel extension 30, and the bolt lugs 48 are locked behind the barrel lugs 38, as best illustrated in FIGS. 9 and 10. The bolt carrier 42 is urged to its forward battery position by the rear recoil spring 43.

In order to load the rifle 10, the operator grasps the bolt handle 68 and pulls the bolt carrier 42 to the rear against the recoil spring 43, simultaneously and automatically unlocking the bolt head 47 from the locking chamber 36 of the barrel extension 30. After the bolt carrier 42 and the bolt 45 are retracted behind the cartridge opening 69, the magazine spring 71 (FIG. 14) urges a cartridge 32 up into the receiver or housing. The bolt handle 68 is then released to let the recoil spring 43 force the bolt carrier 42 forward. Simultaneously, the bolt head 47 picks up the top cartridge 32 projected upwardly by the magazine 70 and carries it forward into the barrel chamber 31, and the bolt head 47 again enters the locking chamber 36 of the barrel collar 30 and is counter-rotated 37 deg. to lock the bolt head 47 within the locking chamber 36.

The rifle 10 is fired by pulling the trigger 20, which lifts the trigger lever 59, to move upward through the transfer bar 58 and the sear 57 to unlatch the hooks 55 and 56 permitting the firing pin 52 to be urged forward by the firing pin spring, not shown, in a conventional manner. The front end of the firing pin 52 projecting from the bolt detonates the primer within the cartridge 32 causing the powder to ignite and rapidly project the projectile or bullet 80 from its cartridge 32 down the barrel 24, as illustrated in FIG. 8.

The forward moving bullet 80 and the expanding gases creates a reaction which drives the barrel 24 rearward against the action of the barrel springs 29.

Figure 8:
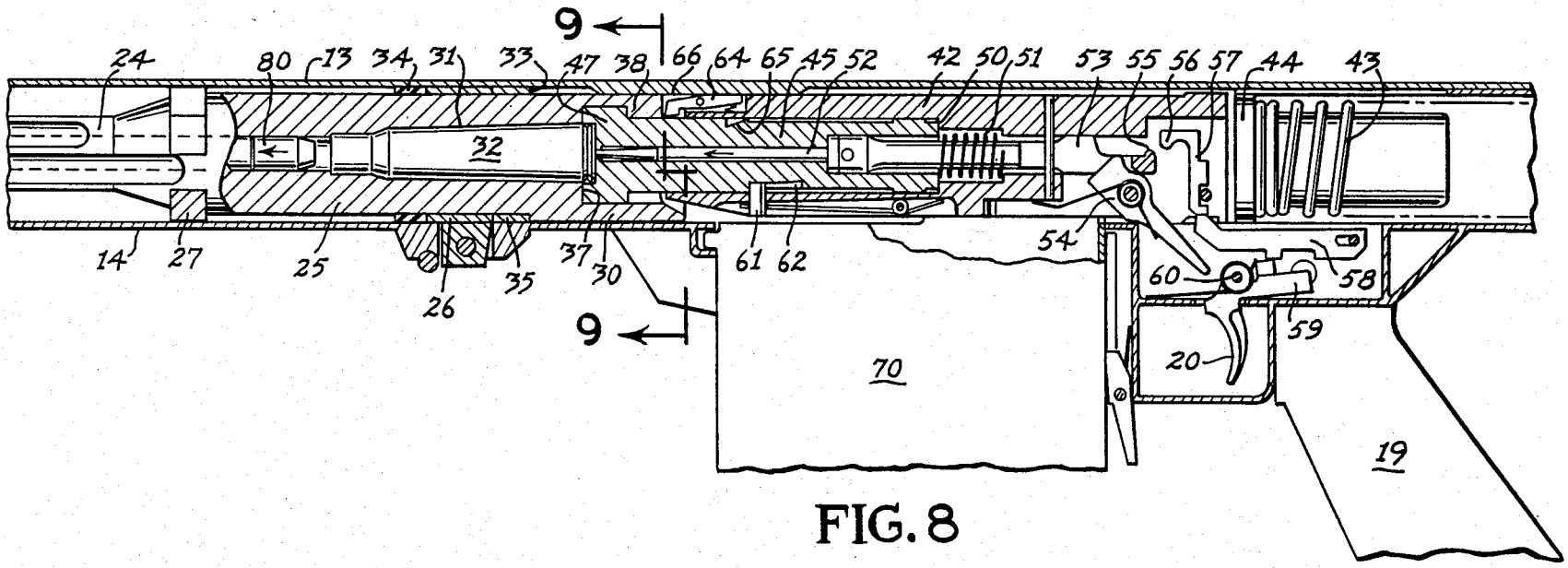
FIG. 8 is a fragmentary sectional elevation of the rifle, similar to that disclosed in FIG. 2, with portions broken away, and illustrating the elements in firing position.

The relative positions of the elements of the gun 13 in battery position are disclosed in FIG. 2, while he relative positions of the elements in the firing position are disclosed in FIG. 8.

As the barrel 24 commences its rearward movement immediately after the firing of the cartridge 32, the bolt carrier 42 and the bolt 45 are likewise carried rearwardly so a substantial mass absorbs the energy of recoil as they move rearwardly against the action of the recoil spring 43.

After the barrel 24 and the bolt carrier 42 have moved rearwardly approximately ½", the bullet 80 is leaving the muzzle of the barrel 24.

After the recoiling barrel 24 and the bolt carrier 42 have moved approximately 1", the self-unlocking lever 73, in its inoperative position, as illustrated in FIG. 2, engages the shoulder 78 which commences the pivoting of the lever 73 about its pivot pin 74. While the self-unlocking lever 73 is in its depending and operative position, the front end of the self-unlocking rod 76 is in flush engagement with the rear face 39 of the barrel extension 30, as illustrated in FIG. 2.

As the self-unlocking lever 73 rides over the abutment shoulder 75, and swings forward, it moves the self-unlocking lever 76 forward against the barrel extension face 39 to move the bolt carrier 42 away from the barrel extension 30 and consequently the barrel 24.

Figure 11:
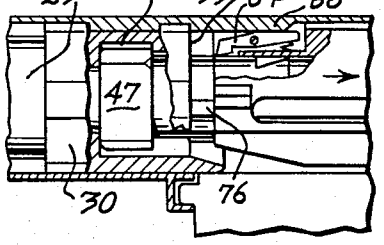
FIG. 11 is a fragmentary sectional elevation similar to FIG. 10, illustrating the bolt in a preliminary stage of separation from the barrel.

As the self-unlocking rod 76 forces the bolt carrier 42 away from the barrel extension 30, the bolt 45 is protracted a corresponding amount, since the bolt head 47 is still locked in the locking chamber 36 (FIG. 11). However, as the bolt protracts relatively from the bolt carrier 42, the bolt body 46 is rotated by virtue of the connection between the cam pin 61 and the helical slot 62. Further rearward relative movement of the bolt carrier 42 away from the barrel extension 30 causes the bolt head 47 to complete its 37 deg. rotation within the unlocking chamber 36 so that the bolt head 47 is free to move rearwardly from the unlocking chamber 36 and rearward past the barrel extension 30 to become completely disengaged from the barrel 24, as illustrated in FIG. 12.

While the self-unlocking rod 76 continues to force the bolt carrier 42 away from the barrel extension 30, the barrel 24 is decelerating, while the bolt carrier 42 is accelerating to increase the separation space between the bolt carrier 42 and the barrel 24.

FIG. 11 discloses the bolt carrier 42 as it begins its separation from the barrel extension 30 with the bolt head 47 rotated through a few degrees from its locked position within the locking chamber 36.

In FIG. 12, the bolt carrier 42 has moved farther away from the barrel extension 30, the bolt head 47 has been counter-rotated through its full 37 deg. so that it registers with the opening between the barrel locking lugs 38, and the bolt 45 is fully protracted relative to the bolt carrier 42 to complete the separation of the bolt carrier 42 from the barrel 24.

After the bolt carrier 42 is fully separated from the barrel extension 30, both elements continue their rearward travel, with the bolt head 42 withdrawing the spent cartridge 32 from the barrel chamber 31.

After the barrel has traveled its full distance of approximately 2½", the abutment member 27 on the barrel 24 impacts against the front resilient buffer member 34 and stop member 26 to stop the rearward movement of the barrel 24. However, because the speed of the rearward movement of the barrel 24 has been reduced, not only by the extension of the barrel springs 29, but also by the self-unlocking rod 76, the impact of the abutment member 27 against the front buffer ring 34 has been substantially reduced by the time the barrel has stopped. The barrel springs 29 then retract the barrel 24 to its forward position, as illustrated in FIG. 2.

Figure 13:
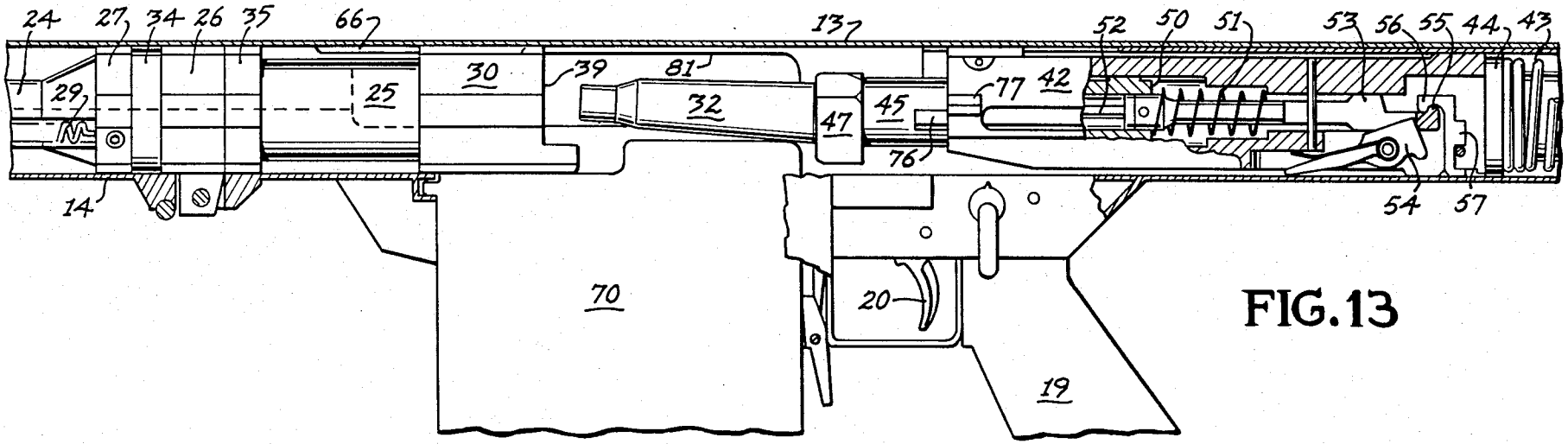
FIG. 13 is an enlarged fragmentary sectional elevation of the rifle in which the bolt has extracted the cartridge and the barrel is in its rearmost position.

As the bolt carrier 42 continues its rearward movement, the extractor, not shown, in the bolt head 47 extracts the spent cartridge 32 and discards it through the ejection opening 81 (FIG. 13) in the upper receiver 13. This extraction process is relatively smooth compared with conventional extraction functions, because the extraction occurs while the barrel 24 and the bolt carrier 42 are still in rearward motion. Moreover, the speed of the extraction of the spent cartridge is the difference between the rearward velocity of the bolt carrier 42 and the rearward velocity of the barrel 24.

After the spent cartridge 32 has been extracted and ejected, and the bolt carrier 42 has reached the limit of its rearward motion, fully compressing the recoil spring 43, the compressed energy in the recoil spring 43 then urges the bolt carrier 42 forward again to pick up another cartridge from the magazine 70, as illustrated in FIG. 14, to carry a fresh cartridge 32 home into the barrel chamber 31, with all of the elements restored to their battery position.

Moreover, when the bolt carrier 42 returns to its battery position, the front end of the self-unlocking rod 76 impacts against the rear face 39 of the barrel extension 30 to force the rod 76 rearward to engage and pivot rearward the self-unlocking lever 73 to its upright, inoperative position, in front of the shoulder 60 and within the lever slot 75, as illustrated in FIG. 2.

The semi-automatic rifle 10, with all of its elements returned to battery position is now in position for a repeat cycle.

Because of the self-unlocking device, including the self-unlocking lever 73, abutment shoulder 78 and self-unlocking rod 76, a recoil of the moving elements in the rifle 10 is reduced. The reduced velocity of the recoiling barrel 24 produces less impact when the barrel is stopped by its engagement with the stop member 26, and thereby produces less felt recoil. Also, as previously mentioned, the extraction of the spent cartridge is accomplished with less abruptness, less shock, and with less wear upon the extractor parts, to produce a smoother extraction operation.

Moreover, because of the increased velocity of the bolt carrier 42 produced by the self-unlocking device, a bolt carrier 42 of reduced mass may be utilized with equal effectiveness in providing sufficient energy for moving the bolt carrier 42 to its extreme rearward position against the action of the recoil spring 43.

Moreover, a muzzle brake 40 of increased efficiency may be utilized, since less recoil action is required for operation, in view of the operation of the self-unlocking device.

What is claimed is:

1. A semi-automatic rifle comprising:

(a) an elongated housing, (b) an elongated bolt carrier received within said housing for longitudinal, reciprocable movement, said bolt carrier having a coaxial forward-opening bolt cavity, (c) an elongated bolt slidably received within and projecting forward from said bolt cavity, said bolt comprising radially projecting bolt locking lugs, (d) bolt spring means in said bolt carrier, normally biasing said bolt forward, (e) cam and slot means interconnecting said bolt carrier to said bolt to provide limited rotary movement of said bolt relative to said bolt carrier during longitudinal movement of said bolt relative to said bolt carrier, (f) an elongated recoil spring within said housing for urging said bolt carrier forward, (g) an elongated barrel comprising an enlarged rear barrel extension, (h) said barrel extension having radially inward directed barrel locking lugs for engaging and disengaging said bolt locking lugs in a battery position, (i) support means in said housing for slidably receiving said barrel, stop means in said housing for limiting the rearward movement of said barrel within said housing, (k) barrel spring means connecting said barrel and said housing to bias said barrel forward to a battery position, (l) a self-unlocking member mounted for longitudinal movement on said bolt carrier and being adapted to engage said barrel extension in said battery position, (m) trip means operatively connected to said self-unlocking member to cause said self-unlocking member to move forward against said barrel extension during the initial recoil movement of said bolt carrier and said barrel to thrust said barrel away from said bolt carrier, thereby automatically causing said bolt locking lugs to rotate relative to said bolt carrier to disengage said barrel locking lugs and to separate said bolt from said barrel.

2. The invention according to claim 1 in which said barrel extension has a rear face, said self-unlocking member comprises an elongated rod and means slidably mounting said rod on said bolt carrier for longitudinal, reciprocable movement, said rod having a front end normally abutting said rear face in said battery position, said trip means being operatively associated with said rod for projecting said rod forward to thrust said barrel extension away from said bolt carrier.

3. The invention according to claim 2 in which said trip means comprises a trip member movably mounted upon said bolt carrier, said rod having a rear end engageable with said trip member, an abutment member on said housing in the path of rearward movement of said trip member whereby engagement of said trip member with said abutment member, when said trip member moves rearward, causes said rod to move forwardly to thrust said barrel extension away from said bolt carrier.

4. The invention according to claim 3 in which said abutment member and said stop means are longitudinally spaced apart upon said housing at such a distance, and the length of said rod is such, that said trip member is actuated to thrust said rod forward to separate said barrel from said bolt carrier before the rearward movement of said barrel is stopped by said stop means.

5. The invention according to claim 4 in which said stop means comprises a barrel travel stop member fixed within said housing and encompassing at least a portion of said barrel, and further comprising a barrel abutment member fixed on and substantially encompassing said barrel and adapted to engage said stop member to limit the rearward movement of said barrel.

6. The invention according to claim 3 in which said trip member comprises a lever arm and means pivotally supporting said lever arm on said bolt carrier above said rod, said lever arm lying in the longitudinal path of said rod and said abutment member, whereby when said lever arm engages said abutment member during the rearward movement of said bolt carrier, said lever arm engages the rear end of said rod for moving said rod forward.

7. The invention according to claim 3 in which said abutment member is in the lower portion of said housing below said bolt carrier.

* * * * *